US006007275A

United States Patent [19]

Børseth

[11] Patent Number: 6,007,275

[45] **Date of Patent: *Dec. 28, 1999**

[54] METHOD AND APPARATUS FOR EMPLOYING STOPPER CHAIN LOCKING MECHANISM FOR TENSION-LEG PLATFORM TENDONS

[75] Inventor: Knut Børseth, Tårnåsen, Norway

[73] Assignee: Petroleum Geo Services AS, Lysaker, Norway

[ * ] Notice: This patent issued on a continued prosecution application filed under 37 CFR 1.53(d), and is subject to the twenty year patent term provisions of 35 U.S.C. 154(a)(2).

[21] Appl. No.: 08/942,188

[22] Filed: Oct. 1, 1997

Related U.S. Application Data

[63] Continuation of application No. 08/601,292, Feb. 16, 1996, abandoned.

[51] Int. Cl.[6] ..... B63B 35/44

[52] U.S. Cl. ..... 405/224

[58] Field of Search ..... 405/223.1, 224, 405/226; 114/264, 265

[56] References Cited

U.S. PATENT DOCUMENTS

| | | | |
|---|---|---|---|
| 3,540,396 | 11/1970 | Horton | 114/265 |
| 3,934,531 | 1/1976 | Allen | 114/63 |
| 4,059,065 | 11/1977 | Clark et al. | 114/256 |
| 4,372,240 | 2/1983 | Michael | 114/56 |
| 4,459,933 | 7/1984 | Burchett | 114/297 |
| 4,604,001 | 8/1986 | Wetmore | 405/224 |
| 4,906,139 | 3/1990 | Chiu et al. | 405/223.1 |
| 4,936,710 | 6/1990 | Petty et al. | 405/224 |
| 5,421,676 | 6/1995 | Wybro et al. | 405/223.1 |
| 5,551,802 | 9/1996 | Wybro | 405/223.1 |

FOREIGN PATENT DOCUMENTS 176395 12/1994 Norway .

OTHER PUBLICATIONS

E.C. Clusky, et al, "The Response of Suction Caissons in Normally Consolidated Clays to Cyclic TLP Loading Conditions," Proceedings of the 27th Annual Offshore Technology Conference, May, 1995, vol. 2, p. 909–918.

J.L. Colliat, et al, "Caisson Foundations as Alternative Anchors for Permanent Mooring of a Process Barge Offshore Congo," Proceedings of 27th Annual Offshore Technology Conference, May 1995, vol. 2, p. 919–929.

"Monopod TLP Improves Deepwater Economics," Petroleum Engineer, Jan. 1993.

*Primary Examiner*—David Bagnell
*Assistant Examiner*—Tara L. Mayo
*Attorney, Agent, or Firm*—Gordon T. Arnold

[57] ABSTRACT

A process comprising: attaching a first end of a chain to the tendon; securing a second end of the chain to the platform. A mechanism comprising: a chain which is attached to the tendon; and a stopper for attaching the chain to the platform. A tension-leg platform (TLP) comprising: a platform for production operations which floats on the surface of the sea; an anchor which attaches to the sea floor; a flexible tendon which connects to the anchor on the sea floor; and a mechanism for attaching the flexible tendon to the platform.

11 Claims, 16 Drawing Sheets

FIG. 1A1
PRIOR ART

FIG. 1A2
PRIOR ART

METHOD AND APPARATUS FOR EMPLOYING STOPPER CHAIN LOCKING MECHANISM FOR TENSION-LEG PLATFORM TENDONS

This application is a continuation of application Ser. No. 08/601,292, filed Feb. 16, 1996 now abandoned.

FIELD OF THE INVENTION

This invention relates generally to deep water, mineral production, tension-leg platform (TLPs) vessels and more specifically to methods and mechanisms for attaching tendons or legs to the platform.

BACKGROUND OF THE INVENTION

Recently, new mineral reservoirs have been discovered at great ocean depths which are not sufficiently productive to merit use of large scale deep sea tension-leg platform structures. Therefore, smaller, less expensive production platforms have been developed which can be transported from one mineral reservoir to another. These platforms use tension-leg mooring, like conventional tension-leg platforms (TLPs), but comprise smaller floatation structures. An example is disclosed in *Monopod TLP Improves Deepwater Economics,* PETROLEUM ENGINEER INTERNATIONAL (January 1993), incorporated herein by reference. Single-piece tendons are used which comprise a length of solid metal with buoyancy devices attached at each end. The tendons are towed to the production site and upended by flooding the lower permanent buoyancy tank. The upper permanent buoyancy tank is oversized so the tendons can be left self-standing. Permanently attached buoyancy tanks make premature detachment impossible. The structure of the TLP is then ballasted by a large derrick and lowered to the previously installed tendons and then deballasted to fully tension the tendons.

Single-piece tendon systems, however, are costly to install and remove. All of the tendons for a given TLP must be installed before the TLP can be attached to the tendons. The TLP must then be ballasted so that it sinks down to the depth of the tendons so that it may be attached to all of the tendons at the same time. Because the TLP is free floating and unstable, it becomes difficult to make the connections between the TLP and the tendons. This means that a very large derrick barge must be brought to the operation site each time the TLP is assembled or disassembled.

Therefore, there is a need for a device and process which more easily attaches a TLP to the tendons.

SUMMARY OF THE INVENTION

An object of the present invention is to address the above problems with a device that allows the TLP to be initially attached to the tendons in a nonloaded state so that tension may then be added to secure the connection.

According to one aspect of the invention, there is provided a process comprising: attaching a first end of a chain to the tendon; securing a second end of the chain to the platform.

According to another aspect of the invention, there is provided a mechanism comprising: a chain which is attached to the tendon; and a stopper for attaching the chain to the platform.

According to a further aspect of the invention, there is provided a tension-leg platform (TLP) comprising: a platform for production operations which floats on the surface of the sea; an anchor which attaches to the sea floor; a flexible tendon which connects to the anchor on the sea floor; and a mechanism for attaching the flexible tendon to the platform.

BRIEF DESCRIPTION OF THE DRAWING

The present invention is better understood by reading the following description of nonlimitative embodiments with reference to the attached drawings, wherein like parts in each of the several figures are identified by the same reference character, which are briefly described as follows:

FIG. 1*a*(1) and 1*a*(2) are plan views of prior art monopod TLP's a plan view of a prior art monopod TLP.

FIG. 11*a*(1) and 11*a*(2) are views of an embodiment of an attacher of the generator to the TLP.

FIG. 11*b*(1) and 11*b*(2) are a plan view of an embodiment of an attacher of the generator to the TLP and a top view of the generator alone, respectively.

It is to be noted, however, that the appended drawings illustrate only typical embodiments of the invention and are therefore not to be considered a limitation of the scope of the invention which includes other equally effective embodiments.

DETAILED DESCRIPTION OF THE INVENTION

Figure 1:
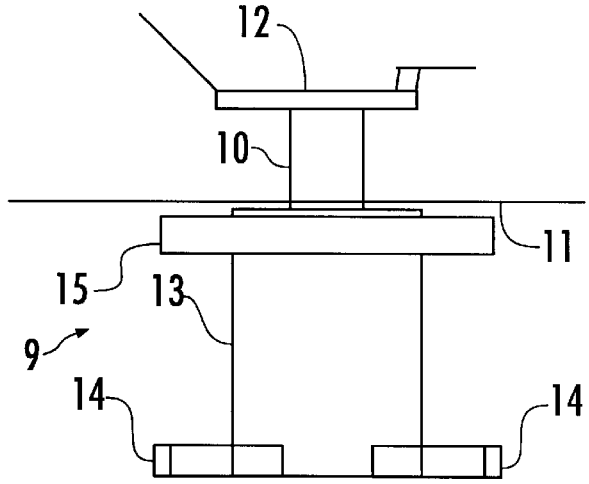
FIG. 1 is a plan view of one embodiment of the inventive tension-leg platform.
Figure 1:
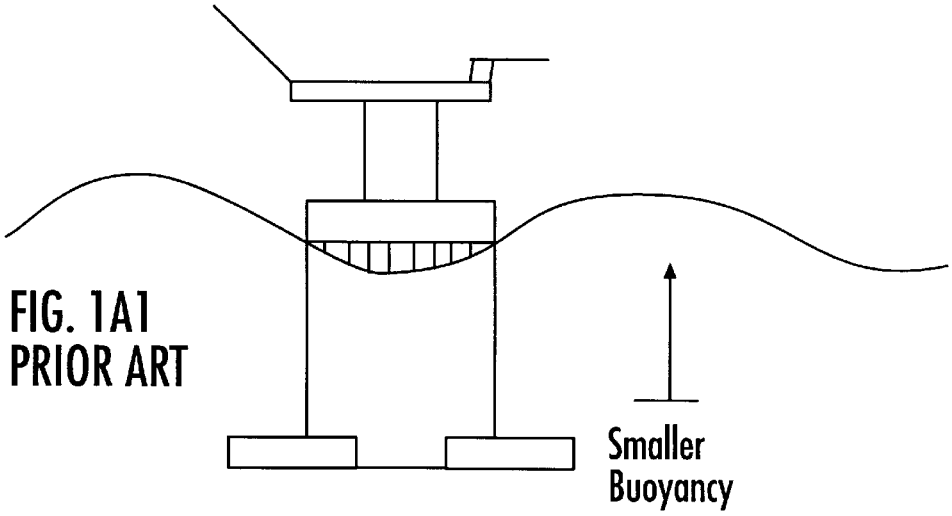
Figure 1:
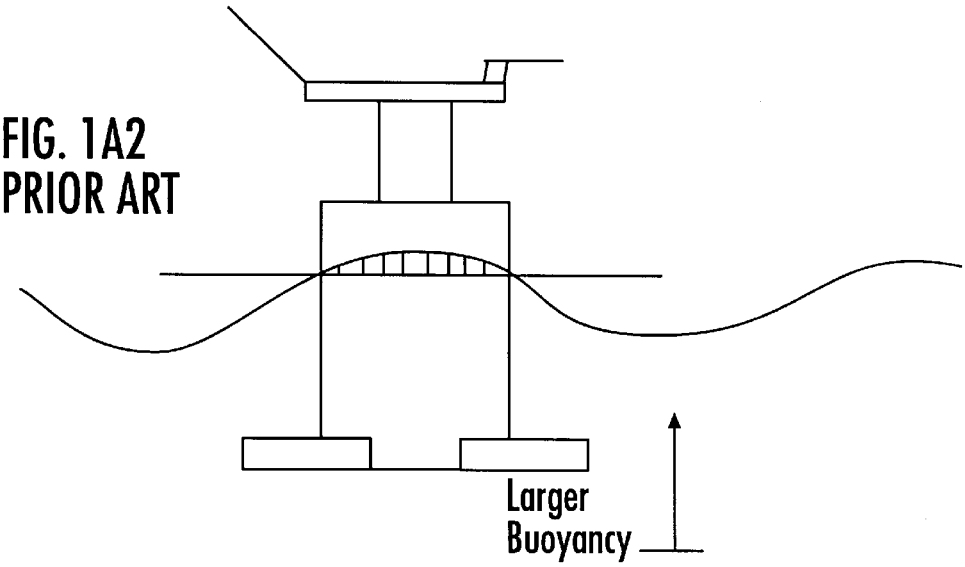

Referring to FIG. 1, one embodiment of a tension-leg platform according to the present invention is shown. The tension-leg platform (TLP) comprises a monopod configuration. The portion of the TLP 9 which extends above the water surface 11 comprises the monopod 10 and the platform 12. The portion of the TLP 9 that extends below the water surface 11 comprises a main buoyancy structure 13, pontoons 14, and a float 15. The main buoyancy structure 13 is cylindrical in shape with its longitudinal axis oriented in a vertical position when the tension-leg platform 9 is arranged in an operational configuration. The pontoons 14 are attached to the bottom of the main buoyancy structure 13 and extend horizontally outward from the central axis of the main buoyancy structure 13. The float 15 is configured so that it encircles the main buoyancy structure 13. Further, float 15 may be moved from a position near the top of the main buoyancy structure 13 to a position at the bottom of main buoyancy structure 13 near pontoons 14. The float 15 comprises a generator of a stabilizing moment because it serves to return the vertical central axis of the TLP to a vertical position upon deflection by wave, wind, etc. which act on the TLP.

Figure 1B:
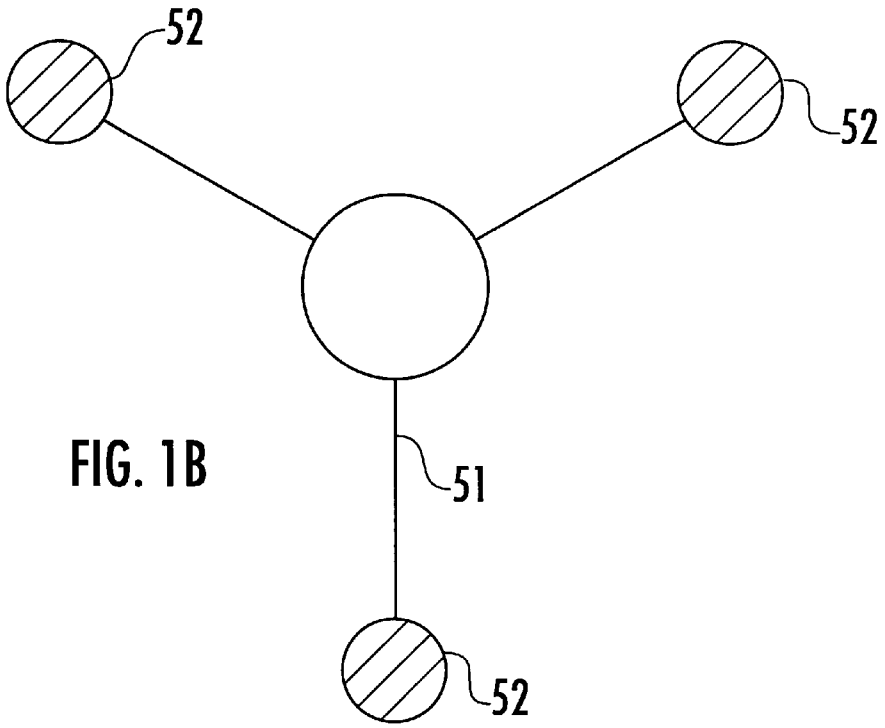
FIG. 1*b* is a top view of an embodiment of a generator of a stabilizing moment.
Figure 1C:
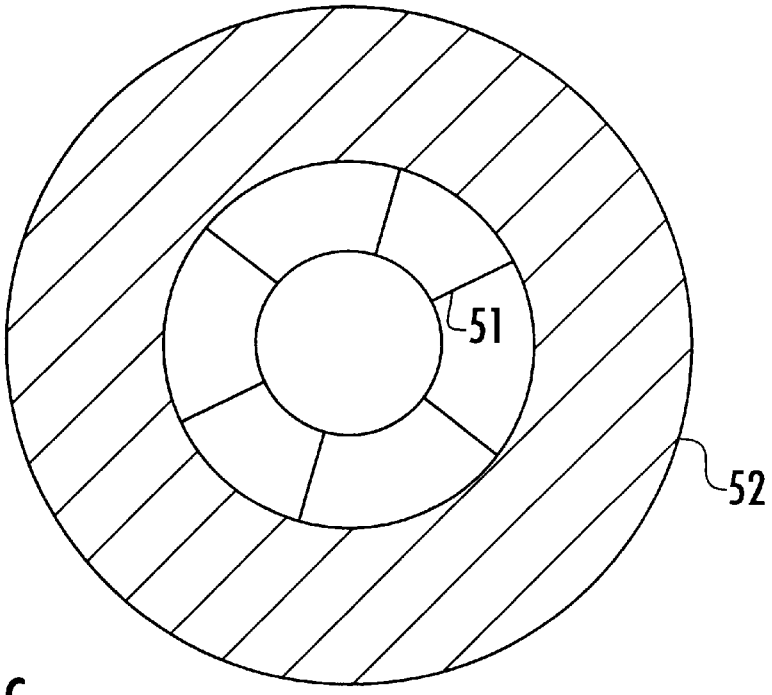
FIG. 1*c* is a top view of an embodiment of a generator of a stabilizing moment.

As shown in FIG. 1*b,* the generator of a stabilizing moment may also comprise a structure with at least three extensions 51 which extend radially out from the central axis of the TLP. Displacers of seawater 52 are attached at the ends of the extensions 51. Also, as shown in FIG. 1*c,* the displacers of seawater 52 may be merged to a single structure. This structure may assume any geometric shape so long as it displaces uniform volumes of seawater symmetrically.

Referring to FIGS. 2 and 3*a*–3*g,* a flow chart is shown for the construction of a tension leg platform and drawings depicting each step of the process, respectively. First, the main buoyancy structure 13 is constructed 201 with the monopod 10 attached. Also, portions of the pontoons 14 are also attached to the main buoyancy structure 13. Further, the float 15 is constructed 201 separately. The main buoyancy structure 13 and float 15 are then launched 202 into the water. At this point, the float 15 lays flat upon the surface of the water while main buoyancy structure 13 is oriented horizontally. The remaining sections of pontoons 14 are attached 202 to the sections which had originally been attached to main buoyancy structure 13. The pontoons are attached in two sections at a time because of the difficulty in transporting main buoyancy structure 13 across a surface when pontoons 14 are too lengthy. Thus, main buoyancy structure 13 is rolled in the water to expose each pontoon in sequence so that an additional section may be added to each. Next, the float 15 is ballasted 203 so that its central axis is oriented in a horizontal direction. The main buoyancy structure 13 is also ballasted 203 so that its central axis is also in a horizontal direction. With the pieces of the tension leg platform in the horizontal orientation, the pieces can be easily assembled. Float 15 is slipped 204 over the monopod 10 and onto the main buoyancy structure 13. It is then attached to the main buoyancy structure 13 at the end closest to the monopod 10. Next, the tension-leg platform is ballasted 205 so that it is oriented with the longitudinal axis of the main buoyancy structure 13 in a vertical direction. The float 15 also has its central axis in a vertical direction and resides just below the surface of the water 11. Thus, the main buoyancy structure 13 and the pontoons 14 extend below the surface of the water while the monopod 10 extends above the surface of the water 11. Note that in this orientation, the tension-leg platform may be transported 206 to the site for operation, although it may also be towed disassembled and assembled on site. Upon reaching the site, the tension-leg platform is ballasted 207 so that the entire tension-leg platform sinks deeper into the water so as to expose only a portion of the monopod 10. A barge 16 is used to transport a platform 12 to the operation site. The barge 16 has a notch 17 which is large enough to encircle the monopod 10. Thus, with the tension-leg platform in a lowered position, the barge 16 may position the platform 12 above the monopod 10. The platform 12 is then assembled 208 to the monopod 10. Finally, the assembled TLP is deballasted 209. The tension-leg platform is now fully assembled and may now be attached to the ocean floor for operation.

Figure 4:
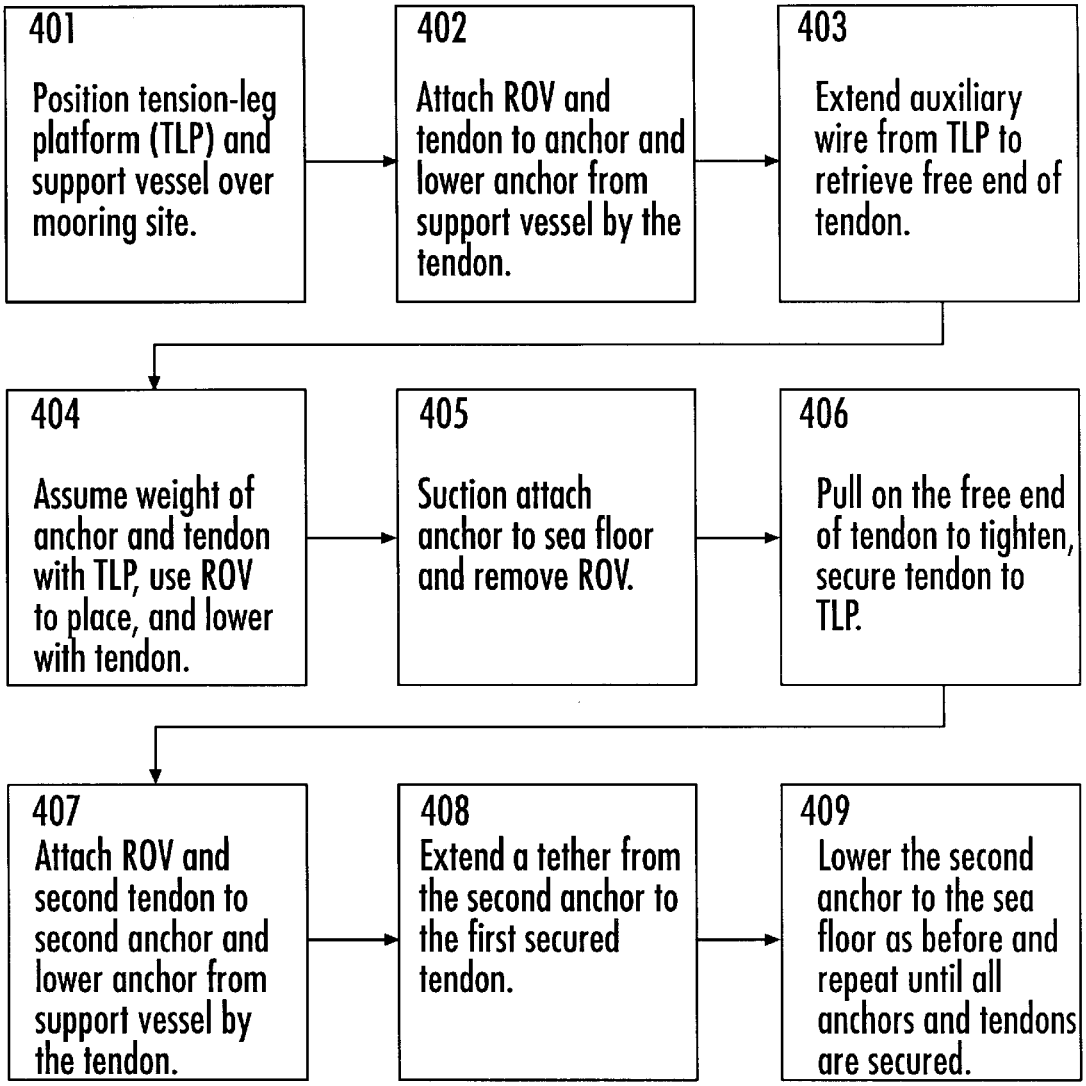
FIG. 4 is a flow chart describing the steps for attaching the tension-leg platform to the sea floor.
Figure 5A:
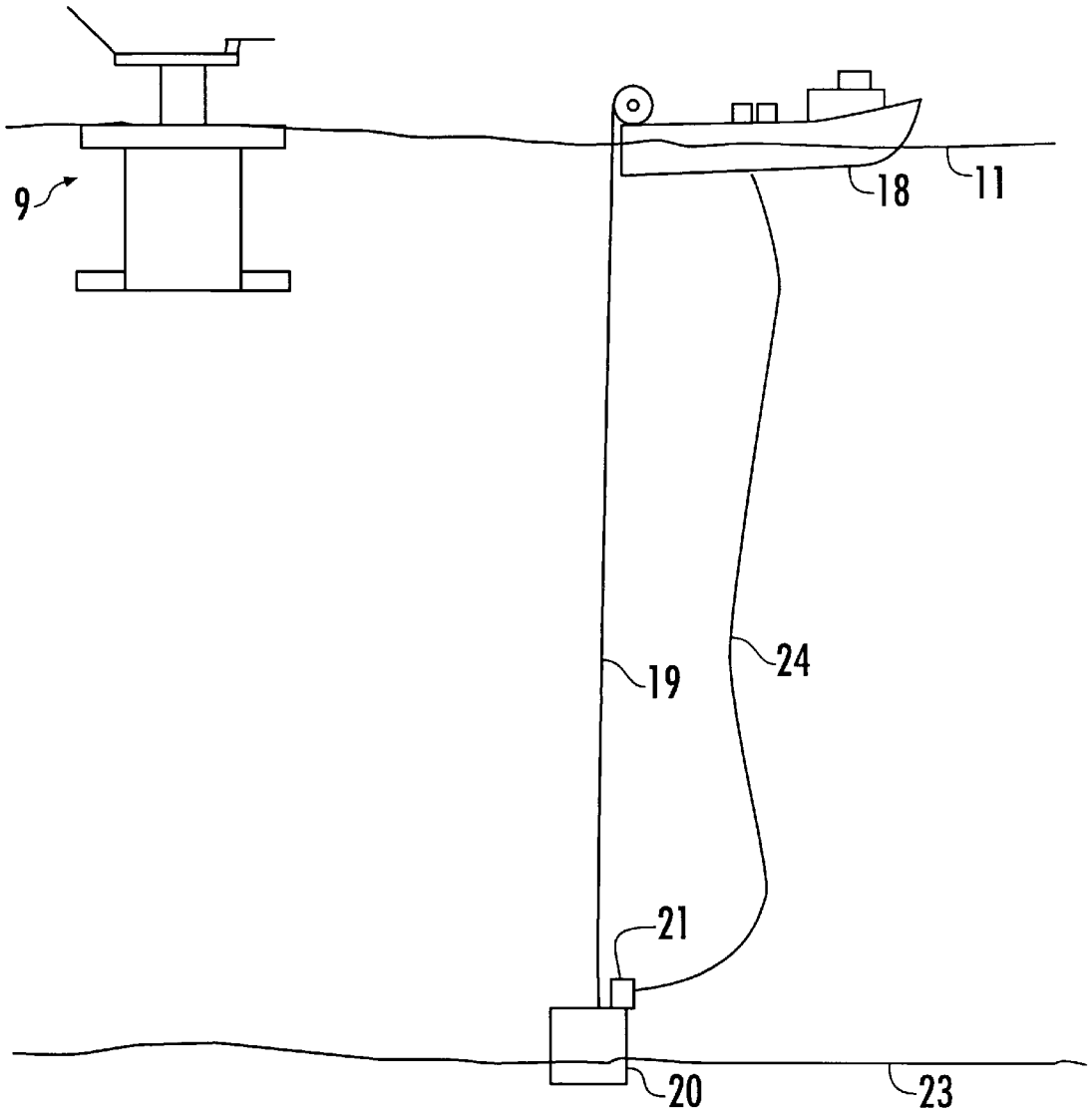
FIG. 5*a* is a plan view of the attachment apparatuses for attaching a tendon of the tension-leg platform to the sea floor in an initial mode of operation.
Figure 5B:
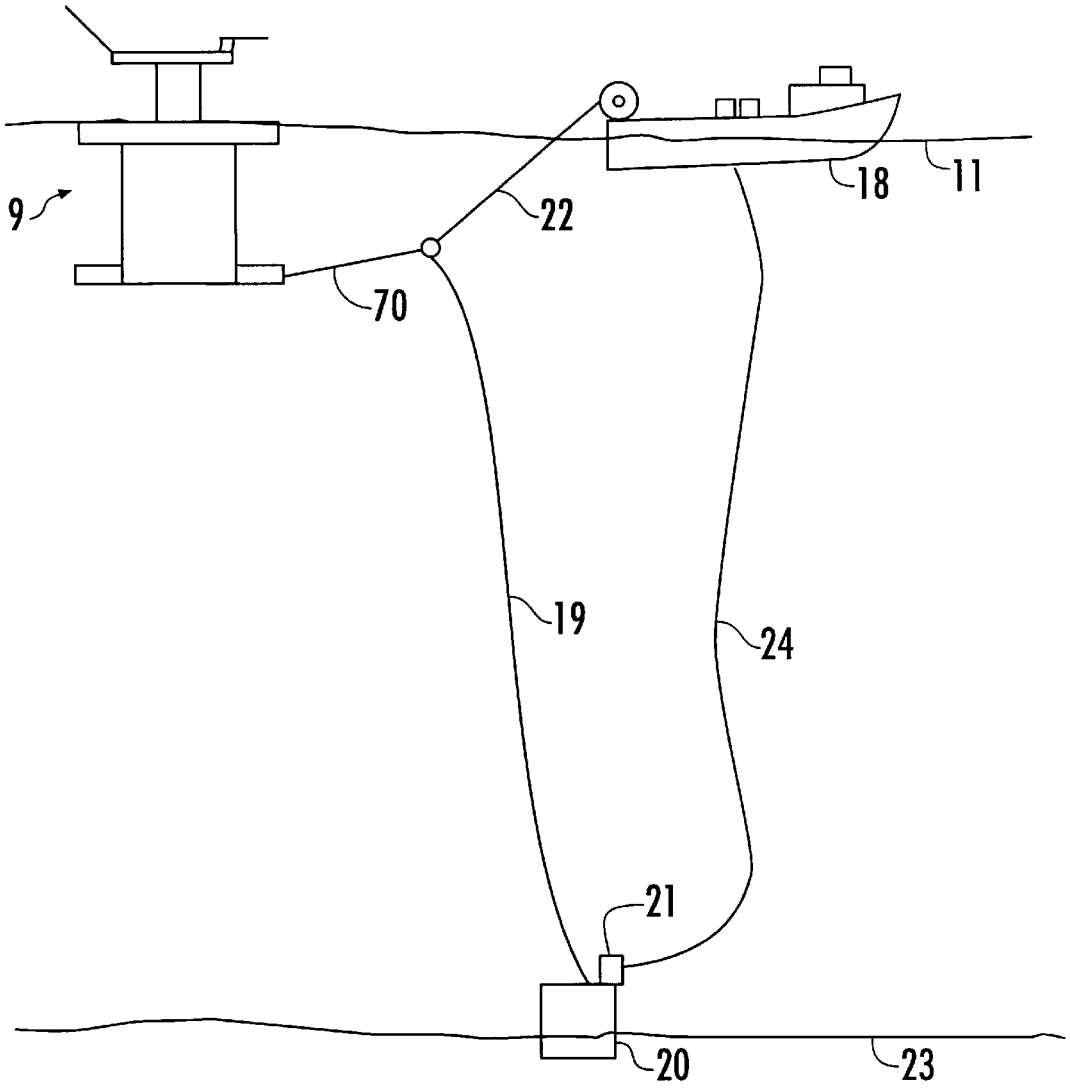
FIG. 5*b* is a plan view of the attachment apparatuses for attaching the tendon to the sea floor in a subsequent mode of operation.
Figure 5C:
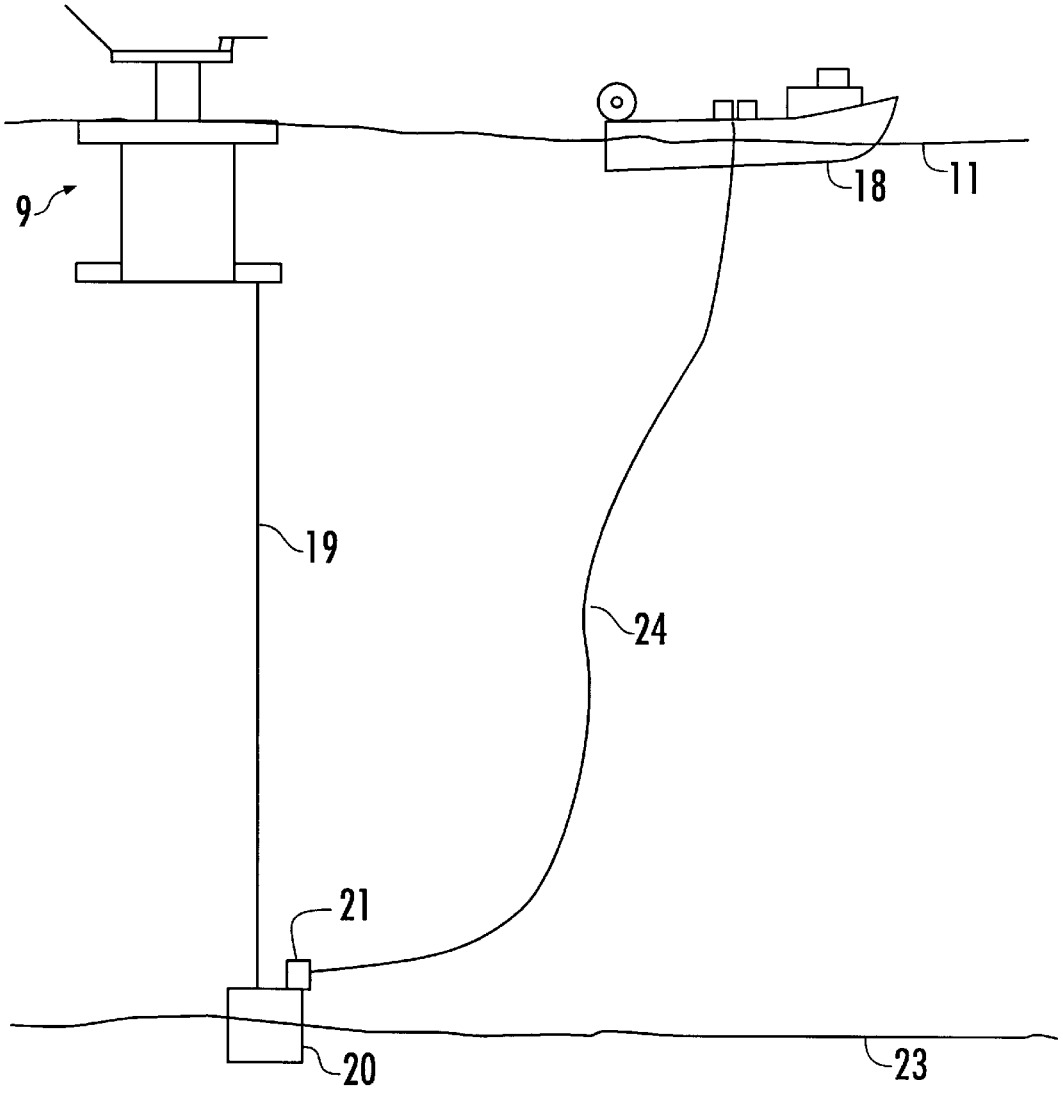
FIG. 5*c* is a plan view of the attachment apparatuses for attaching the tendon to the sea floor after the tendon is secured.
Figure 6:
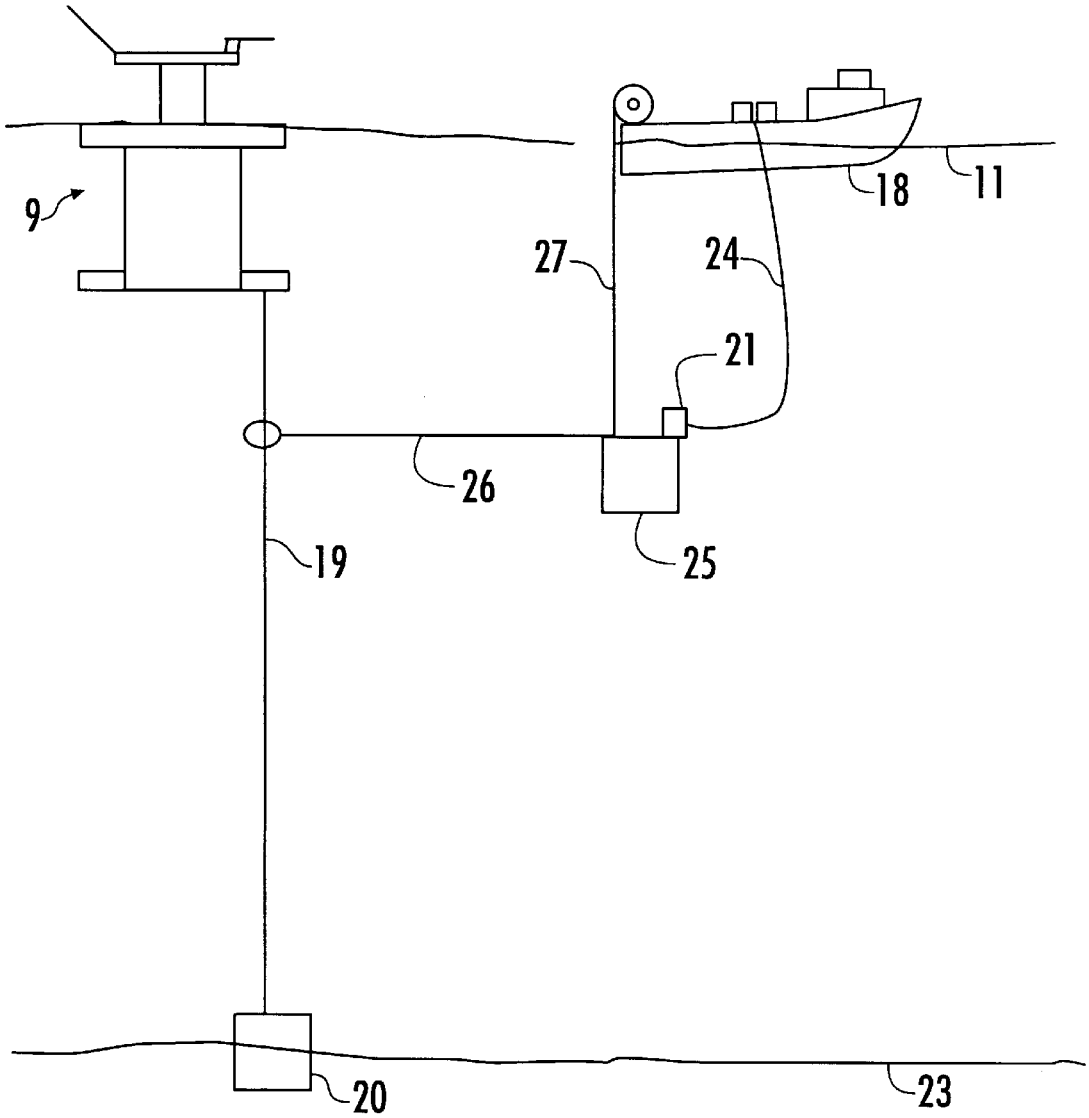
FIG. 6 is a plan view of the attachment apparatuses for attaching a second tendon to the sea floor.

Referring to FIGS. 4, 5*a,* 5*b,* 5*c* and 6, steps for the process of attaching the tension leg platform to the sea floor and drawings disclosing the process are shown. First, a tension leg platform 9 and a support vessel 18 are both positioned 401 over the mooring site. A tendon 19 and a remotely operated vehicle (ROV) are attached 402 to and anchor 20. The anchor 20 is lowered from the support vessel 18 by the tendon 19. As the suction anchor and ROV are lowered towards the sea floor 23, the tendon 19 is unspooled from the support vessel 18. An umbilical cord 24 for the ROV and suction anchor is attached to the ROV and is also unspooled as the suction anchor is lowered. After the anchor 20 is placed on the sea floor 23, an auxiliary wire 70 is extended 403 from the TLP 9 to retrieve the free end of the tendon 19 as it is released from the support vessel 18. Alternatively, the free end of the tendon 19 may be transferred before the anchor 20 reaches the sea floor 23 by the auxiliary wire 70 and a hook wire 22. The weight of the anchor and tendon would then be supported by the auxiliary wire 70 and hook wire 22 during the transfer.

The weight of the tendon 19 and suction anchor 20 is then assumed 404 by the TLP and the ROV is used 404 to place the anchor 20 in the desired location. This is done because the tension leg platform 19 is much more stable than the support vessel 18 so as to provide more stability when placing the suction anchor 20 upon the sea floor 23. The ROV 21 is operated 404 to place the suction anchor 20 in the desired location while the tendon 19 lowers the suction anchor 20 to the sea floor 23. The suction anchor 20 is then attached 405 to the sea floor 23 and the ROV is removed 405. This procedure is more fully described below. A winch or other pulling device is then used to pull 406 on the free end of the tendon 19 until the desired tension is obtained. Finally, the tendon 19 is secured 406 to the TLP. This attachment step 406 is more fully described below.

Upon deposit of the suction anchor 20 on the sea floor, the ROV 20 and auxiliary wire 22 are returned 405 to the support vessel 18 where they are again attached 407 to a second suction anchor 25. A second tendon 27 is also attached 407 to the anchor 25. Additionally, a tether 26 is attached 408 from the anchor 25 to the tendon 19 which is already secured to the sea floor 23. Again, the tendon 27 is used to lower 409 the anchor 25 to the sea floor 23. The free end of the tendon 27 is transferred to the TLP and the ROV 21 is used to pull the anchor 25 horizontally away from anchor 20 so that tether 26 is fully extended. Tendon 27 then lowers anchor 25 to the sea floor 23 where it is attached. The process is then repeated for subsequent anchors until all anchors are placed on the sea floor 23 in their proper positions.

Figure 7:
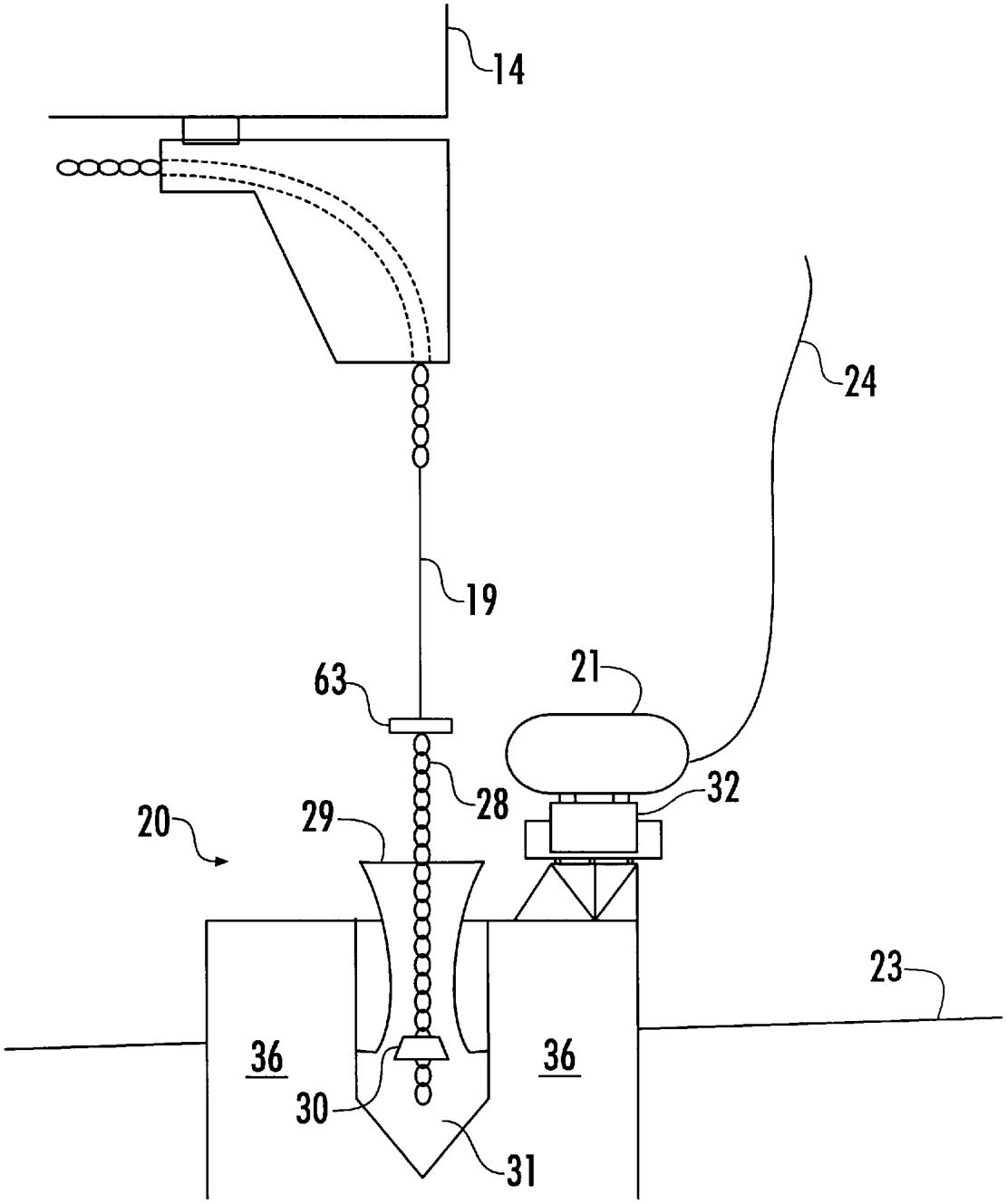
FIG. 7 is a plan view of the tendon and suction anchor.

Referring to FIG. 7, one embodiment of the suction anchor is shown. First of all, the tendon 19 is attached to one end of a chain 28. A spinner 63 is used to make the connection so that the tendon 19 may rotate relative to the chain 28. The other end of the chain 28 is inserted into a funnel 29 located near the top of the anchor 20. Inside the funnel 29, the chain 28 is engaged by a chain stopper 30 which locks it into place. Excess links of the chain 28 are stored in a chain locker 31 below the funnel 29.

In one embodiment, for a TLP weighing about 6000 tons, the chain 28 may comprise 4 inch, oil-rig-quality chain. The tendon may comprise spiral strand wire having a 110 mm diameter. Further, the suction anchor 20 may be made of single steel cylinders with a wall thickness of 20 mm. The total weight of the anchor may range from about 25 tons (3.5 m diameter and 7.5 m long) to about 40 tons (5 m diameter and 11 m long). See J- L. Colliat, P. Boisard, K. Andersen and K. Schroeder, *Caisson Foundations as Alternative Anchors for Permanent Mooring of a Process Barge Offshore Congo,* OFFSHORE TECHNOLOGY CONFERENCE PROCEEDING, Vol. 2, pgs. 919–929 (May 1995); E. C. Clukey, M. J. Morrison, J. Garnier and J. F. Cortè, *The Response of Suction Caissons in Normally Consolidated Clays to Cyclic TLP Loading Conditions,* OFFSHORE TECHNOLOGY CONFERENCE PROCEEDING, Vol. 2, pgs 909–918 (May 1995), both incorporated herein by reference.

Figure 8A:
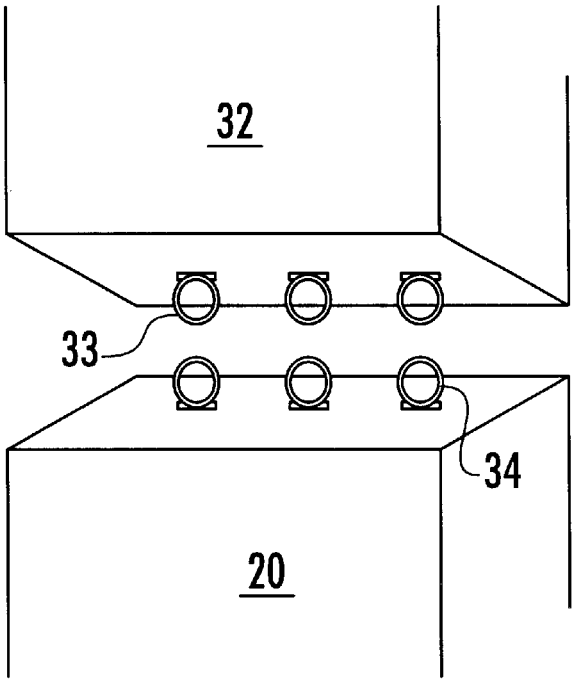
FIG. 8*a* is a plan view of the ROV-POD and anchor.
Figure 8B:
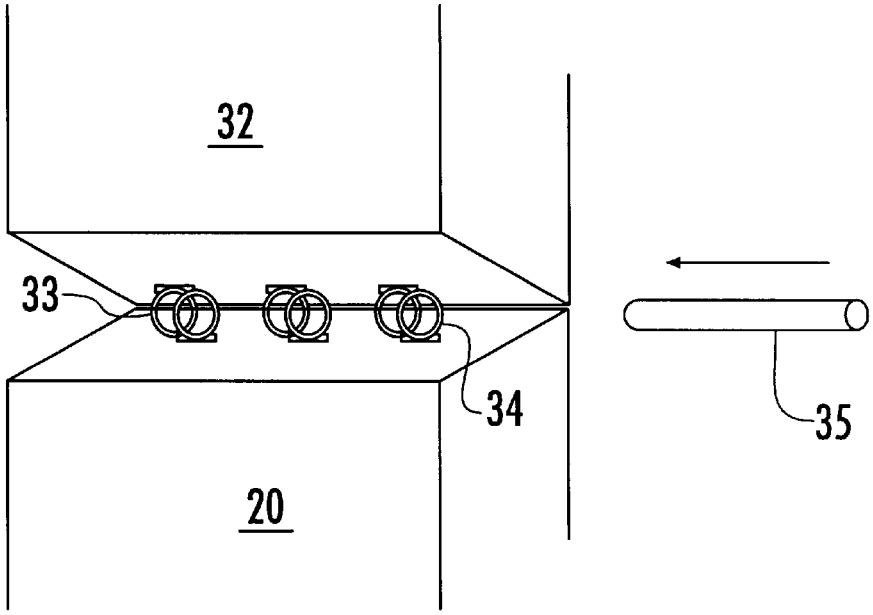
FIG. 8*b* is a plan view of the ROV-POD, anchor and attachment dowel.

The ROV 21 is attached to a ROV pod 32. The ROV pod 32 in turn engages the anchor 20. As shown in FIG. 8*a,* the ROV pod 32 comprises a series of rings 33. The anchor 20 also has a series of rings 34. The devices are connected by bringing the ROV pod 32 in close proximity with the anchor 20 so that rings 33 are placed adjacent to rings 34. As shown in FIG. 8*b,* with the rings juxtaposed, a dowel 35 may be inserted into the rings 33 and 34 to connect the ROV pod 32 to the anchor 20.

Referring again to FIG. 7, the anchor 20 also comprises a series of chambers 36. Each of these chambers are closed on all sides with the exception of the bottom side which is adjacent to the sea floor 23. The anchor is attached to the sea floor 23 by pumping air into the chambers 36 with air supplied by umbilicals 24. Water is pushed out from the chambers by the air through one-way valves between the chambers and the exterior of the anchor. Once the chambers are filled with air, the air is immediately evacuated to create low pressure inside the chambers. This creates a suction which causes the anchor to adhere to the sea floor 23. The air may be evacuated by pumps or by allowing the air in the anchor to be exposed to atmospheric pressure at the sea surface via a hose. When the anchor is to be released from the sea floor, air is pumped back into the chambers to increase the pressure. Multiple chambers 36 provide redundancy to prevent the entire anchor from becoming detached should one of the chambers fail.

Figure 9A:
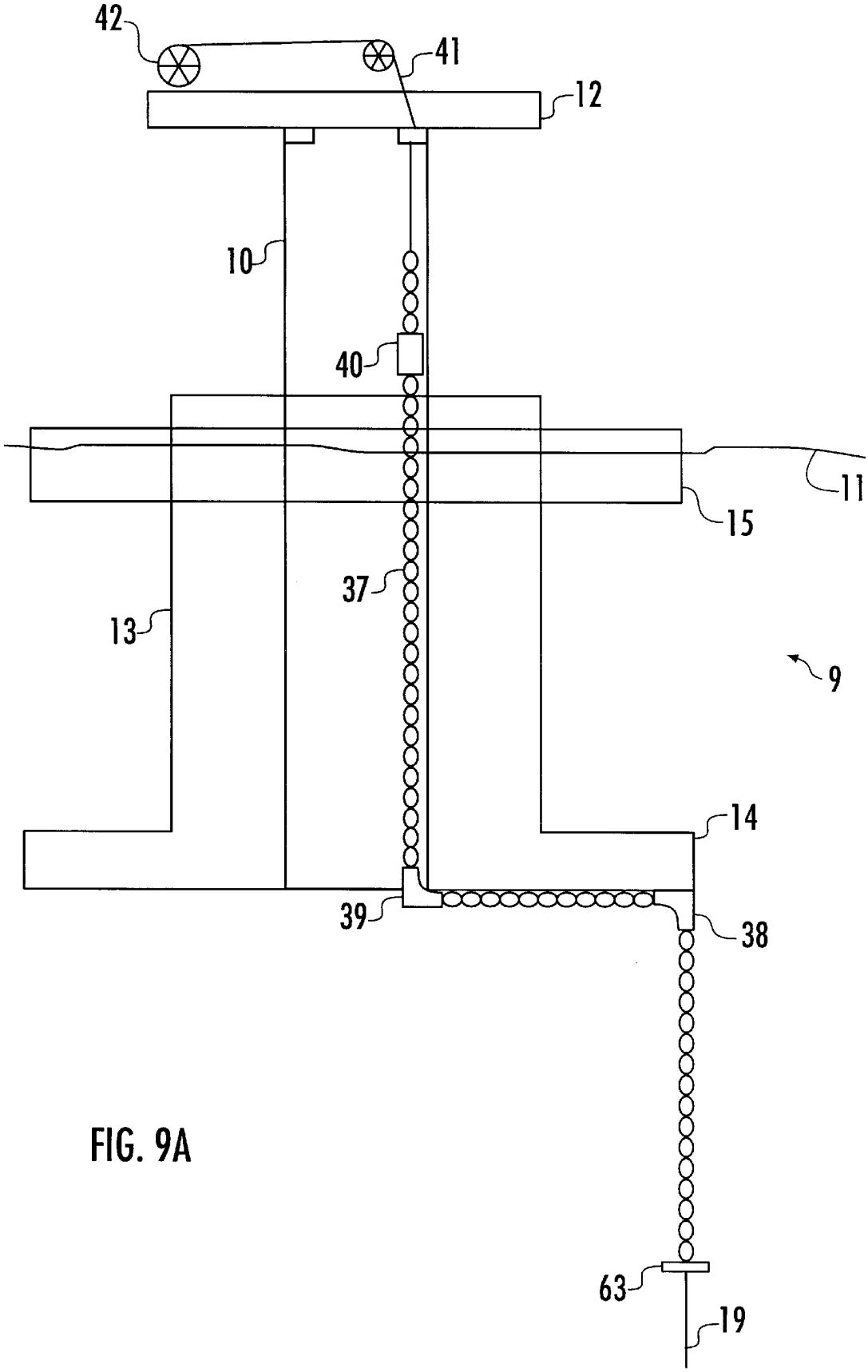
FIG. 9*a* is a plan view of the apparatus for attaching the tendon to the tension-leg platform.

Referring to FIG. 9*a,* an embodiment is shown for attachment of the tendon 19 to the tension-leg platform 9. The tendon 19 is attached to a chain 37 with a spinner 63 in between. The spinner 63 allows the tendon 19 to rotate relative to the chain 37. The chain 37 enters the tension leg platform 9 through one of the pontoons 14. The chain 37 is then directed through the pontoon 14 and up through the main buoyancy structure 13 of the tension-leg platform 9. A deflector 38 is located at the point where the chain enters pontoon 14 so as to deflect the direction of the chain. The chain enters the pontoon in a vertical direction and is deflected by a fairlead or deflector 38 toward the central axis of the buoyancy structure 13. Toward the interior of the main buoyancy structure 13, the chain is again deflected by a second fairlead or deflector 39 which directs the chain vertically toward the monopod 10.

Figure 9B:
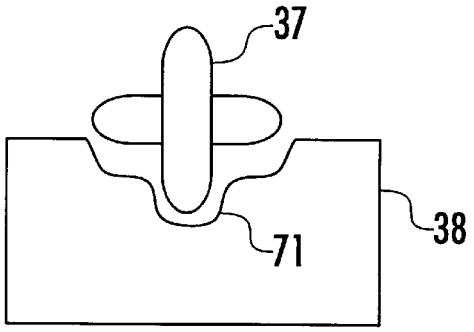
FIG. 9*b* is a side view of a sliding deflector.
Figure 9C:
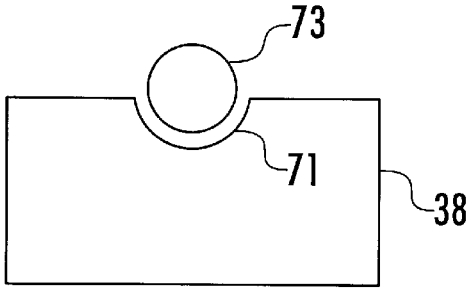
FIG. 9*c* is a side view of a sliding deflector.

These deflectors may comprise pulleys, sliding material, or any other device known. FIG. 9*b,* shows a side view of sliding deflector embodiment. The chain 37 slides within a groove 71 in the deflector 38 which conforms to the shape of the chain. Alternatively, as shown in FIG. 9*c,* a cable 73 may by deflected by the deflector 38 in which case the groove 71 conforms to the shape of the cable 73. MONO-LOY material, produced by Smith-Berger of Vancouver, Wash., is a suitable sliding material.

Referring again to FIG. 9*a,* a wire 41 is attached to the free end of the chain 37. The wire 41 is engaged by a handling winch 42 which pulls the free end of the chain 37 vertically so that the chain 37 and the tendon 19 become tight. When a desired tension is obtained, the chain 37 is locked into place by a stopper 40 which is located in the monopod 10. A stopper 40 may comprise two protrusions which straddle a link of the chain so as to catch the next subsequent link in the chain. However, automatic stopping system, known in the art, may also be used. This stopper 40 may comprise a series of stoppers which engage the chain 37 at various positions. Multiple stoppers are used to provide redundancy should one of the stoppers fail. It should be understood that the stoppers may be located anywhere inside the tension leg platform 9, however, placement inside the monopod makes them easily accessible. Further, a similar chain configuration is used for each of the tendons 19 which are used to secure the tension leg platform 9 to the sea floor 23. The winch 42 and wire 41 in one embodiment are used to induce tension in each of the tendons 19, 27, etc., sequentially.

Figure 10A:
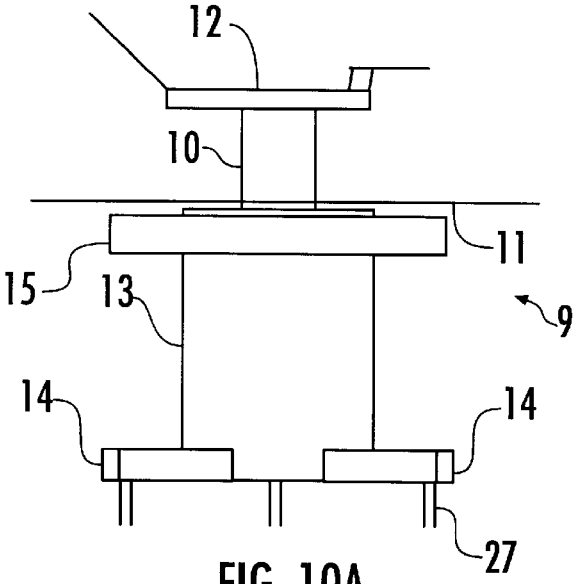
FIG. 10*a* is a plan view of the tension-leg platform in a presecured configuration.
Figure 10B:
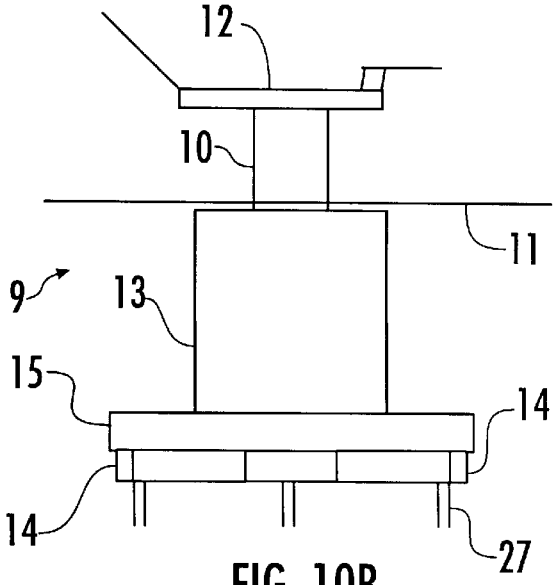
FIG. 10*b* is a plan view of the tension-leg platform in a postsecured configuration.

Referring to FIGS. 10*a* and 10*b,* embodiments of the present invention are shown. In FIG. 10*a,* configuration of the float 15 is such that it is affixed towards the upper end of main buoyancy structure 13. In this configuration, the float 15 provides stability to the tension leg platform 9 because of the increased water displacement at the surface of the water. Thus, in this configuration, the tension-leg platform 9 has increased stability which is important during the attachment of the tendons 27 to the sea floor 23 and to the tension-leg platform 9.

However, as soon as the tendons 27 are securely in place, the water displacement at the surface is no longer needed. In fact, once the tension-leg platform 9 is secured to the sea floor, increased surface area of the tension leg platform 9 at the surface of the water 11 is detrimental. As the waves act on the large surface area of the float 15 (see FIG. 1*a*(1) and 1*a*(2)), they induce resonance in the tension-leg platform 9 until the amplitude of the resonance is such that the tendons 27 begin to break. Therefore, as shown in FIG. 10*b,* once the tendon leg platform 9 has secured to the sea floor, the float 15 is moved by a mover so that it is lowered until it abuts against the pontoons 14. The mover of the float 15 may comprise ballast, a pulley cable system, a hydraulic system, or any other system known. The float 15 is then attached to the pontoons 14 and to the main buoyancy structure 13 and the ballast is removed. Thus, the float 15 provides buoyancy to the tension leg platform 9 below the wave zone of the sea. In this configuration, the tension-leg platform 9 has a smaller cross section upon which the waves at the surface act. Additionally, with the float secured to the tension leg platform 9, the added buoyancy allows the tension leg platform to support several risers (not shown) which will be brought from the sea floor.

In this regard, the float 15 comprises a reducer of the size of the TLP in the wave zone because once the float 15 is submerged to where it no longer pierces the surface of the sea, it does not displace seawater in the wave zone. The reducer of the size of the TLP in the wave zone may also comprise a device which removes or reconfigures TLP structural elements so that less water is displaced in the wave zone. For example, a crane may be used to remove members which support the TLP during transportation and assembly, but which are not required when the TLP is secured to the sea floor.

Figure 11C:
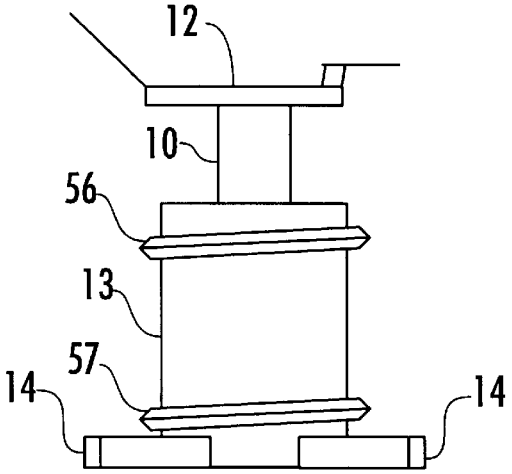
FIG. 11*c* is a plan view of an embodiment of an attacher of the generator to the TLP.
Figure 11C:
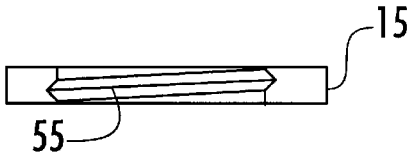
Figure 11C:
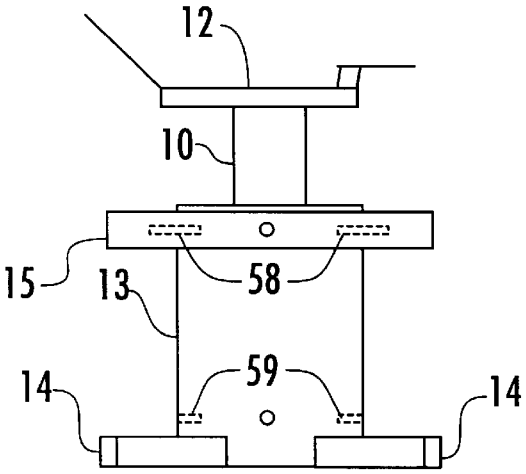
Figure 11C:
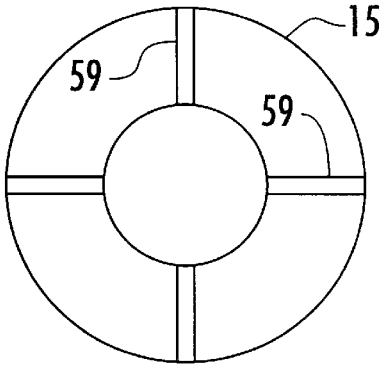
Figure 11C:
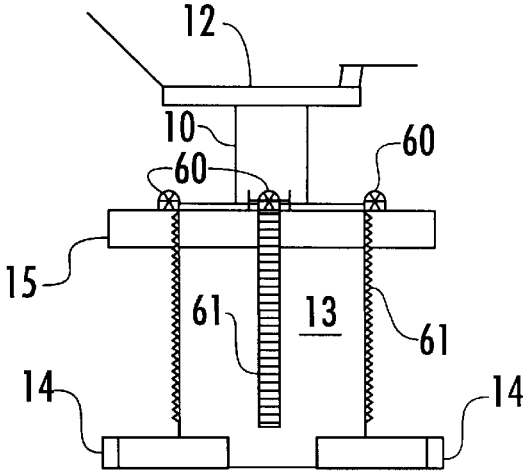

Referring to FIG. 11*a*(1) and 11*a*(2)), an attacher of the float to the TLP is shown. The generator of a stabilizing moment (float 15) comprises a generator thread 55 which allows float 15 to be twisted first onto the TLP thread 56 and second onto TLP thread 57. As shown in FIG. 11*b*(1) and 11*b*(2), the attacher may comprise dowels 58 which extend between the TLP and the generator of a stabilizing moment (float 15) through dowel holes 59. In FIG. 11*c*, the attacher is shown to comprise generator teeth 60 and TLP teeth 61. The TLP teeth 61 are tracks of teeth which extend parallel to the TLP central axis on the outside of the main buoyancy structure 13. The generator teeth 60 are gears mounted on the generator of a stabilizing moment 15 for engagement with the TLP teeth 61.

It is to be noted that the above described embodiments illustrate only typical embodiments of the invention and are therefore not to be considered a limitation of the scope of the invention which includes other equally effective embodiments.

I claim:

1. A process of securing a tendon to a platform of a tension-leg platform (TLP), the platform having at least one pontoon attached near its periphery, the process comprising:

attaching a first end of a chain to the tendon;

passing the chain through a first deflector attached to one of the pontoons of the platform near its outer periphery;

passing the chain through a second deflector attached to the platform near its vertical center axis; whereby the first and second deflectors together displace the chain from being vertically disposed near the outer periphery of the platform to being vertically disposed near the vertical center axis of the platform; and securing the second end of the chain to the platform.

2. An apparatus for attaching a flexible tendon to a tension-leg platform (TLP), the TLP comprising a buoyancy structure having a central axis and at least one pontoon attached near the lower periphery of the buoyancy structure, the apparatus comprising:

a first deflector attached to the pontoon for deflecting the direction of the tendon so that the tendon enters the first deflector in a vertical direction and exits it directed toward the central axis of the buoyancy structure;

a second deflector attached to the buoyancy structure for again deflecting the direction of the tendon so that the tendon enters the second deflector directed toward the central axis of the buoyancy structure and exits it directed vertically upward for attachment to the TLP.

3. The apparatus of claim 2, wherein the first and second deflectors comprise pulleys.

4. The apparatus of claim 2, further including a chain attached to the upper end of the tendon, and wherein the chain passes through at least one of the first and second deflectors.

5. The apparatus of claim 4, wherein the first and second deflectors comprise sliding material which conforms in shape to the cross section of the chain.

6. A mechanism as in claim 4 further comprising a spinner attached between the chain and the tendon for permitting relative rotation therebetween about the longitudinal axis of the tendon.

7. A mechanism as in claim 4, further comprising a winch and a wire, wherein a first end of said wire is spooled on said winch and a second end of said wire is attached to said chain, for inducing tension in said chain and tendon.

8. A tension-leg platform (TLP) system for deep water mineral production, the TLP comprising:

a platform for production operations which floats on the surface of the sea; the platform having at least one pontoon attached near its periphery;

an anchor which attaches to the sea floor;

a flexible tendon which connects to said anchor on the sea floor;

a chain attached to the tendon;

a first deflector of said chain attached to one of the pontoons of the platform near its outer periphery;

a second deflector of said chain attached to the platform near its vertical center axis; whereby the first and second deflectors together displace the chain inwardly from being vertically disposed near the outer periphery of the platform to being vertically disposed near the vertical center axis of the platform; and a stopper for attaching the chain to the platform.

9. A system as in claim 8, further comprising a spinner attached between the chain and the tendon for permitting relative rotation therebetween about the longitudinal axis of the tendon.

10. A system as in claim 8, wherein said first and second deflectors have grooves in their surfaces, the shape of the grooves conforming to the shape of the chain links for sliding engagement therewith.

11. A system as in claim 8, further comprising a winch and a wire, wherein a first end of said wire is spooled on said winch and a second end of said wire is attached to said chain, for inducing tension in said chain and tendon.

* * * * *

UNITED STATES PATENT AND TRADEMARK OFFICE

CERTIFICATE OF CORRECTION

PATENT NO. : 6,007,275
DATED : December 28, 1999
INVENTOR(S) : Knut Borseth

It is certified that error appears in the above-identified patent and that said Letters Patent is hereby corrected as shown below:

On the first page of the patent, a second reference under the heading foreign patent documents is missing. The reference "4829 12/1895 Norway" should be added.

Figure 2:
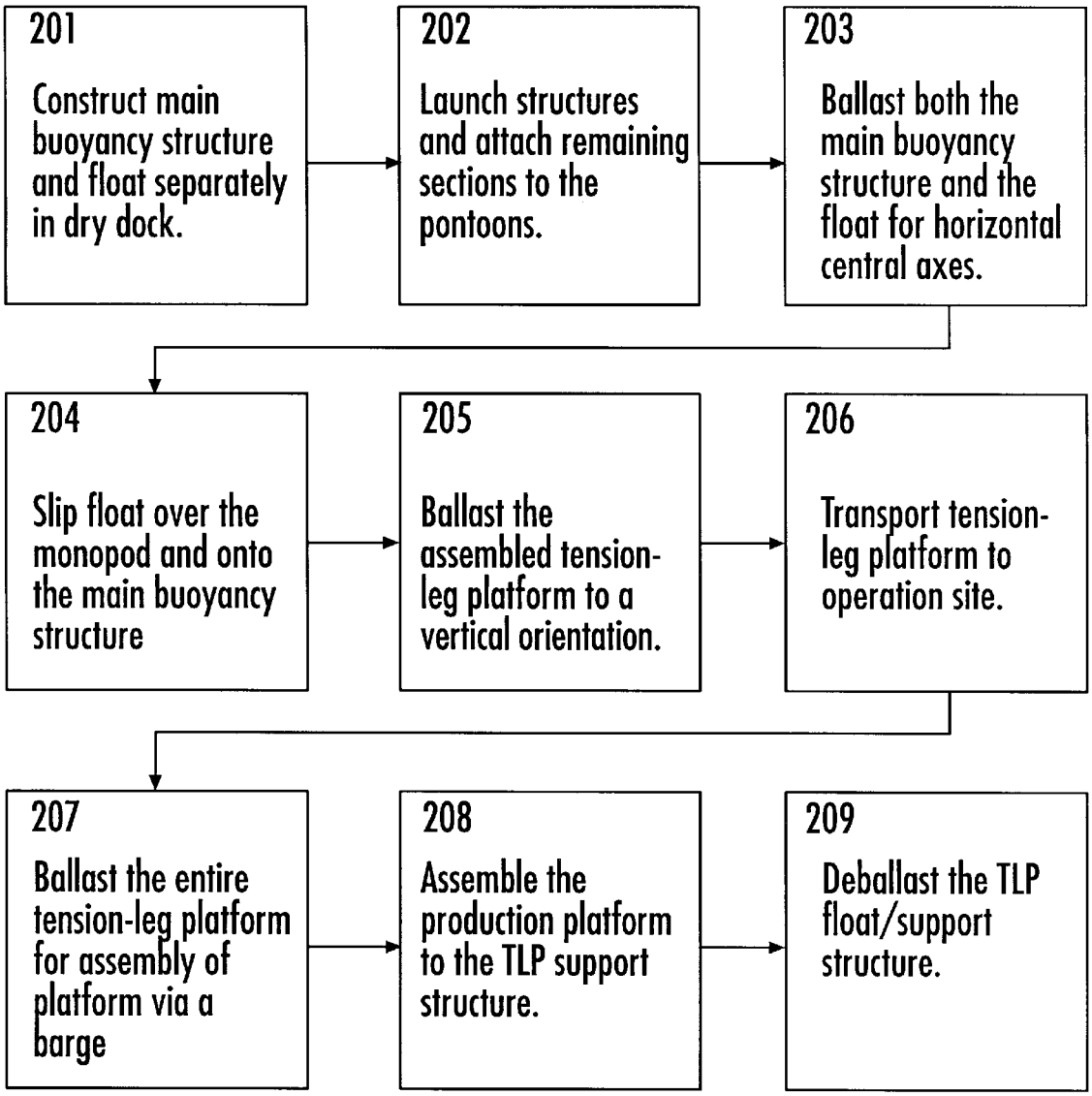
FIG. 2 is a flow chart describing the steps for assembling the tension-leg platform.
Figure 3A:
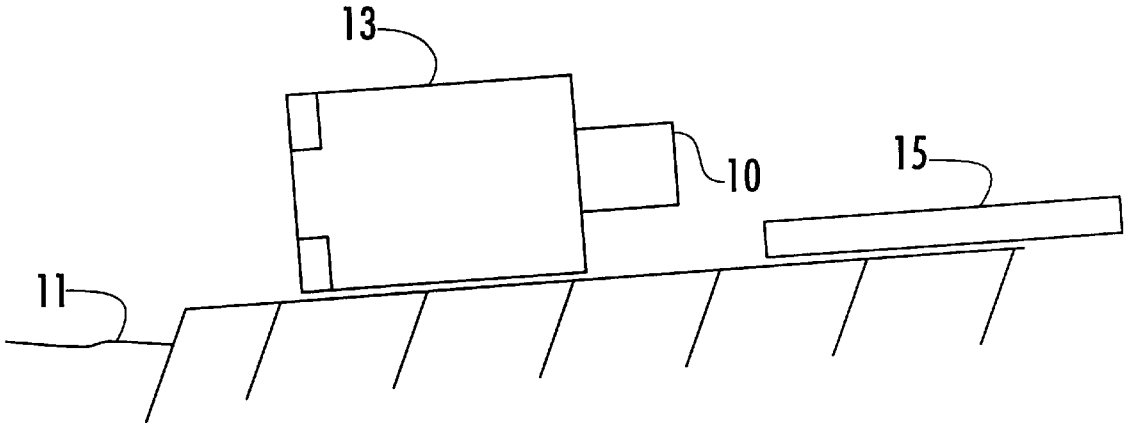
FIG. 3*a* is a plan view of the main buoyancy structure and float as constructed on land.
Figure 3B:
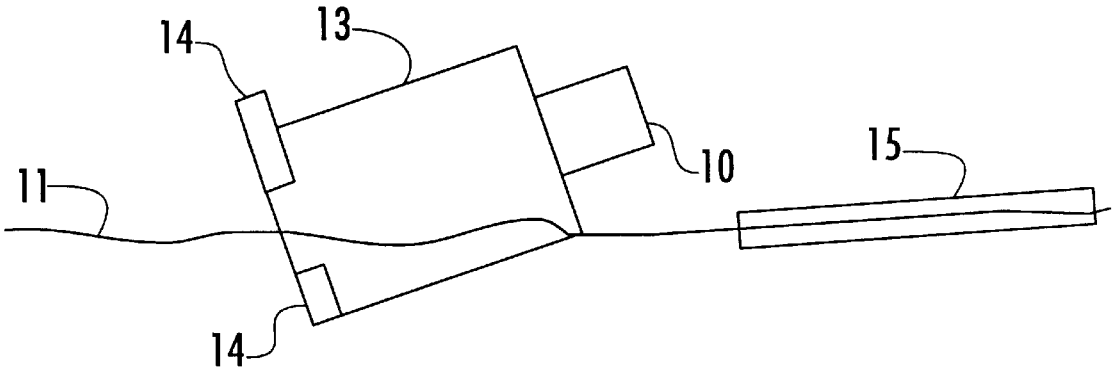
FIG. 3*b* is a plan view of the main buoyancy structure and float launched into the water.
Figure 3C:
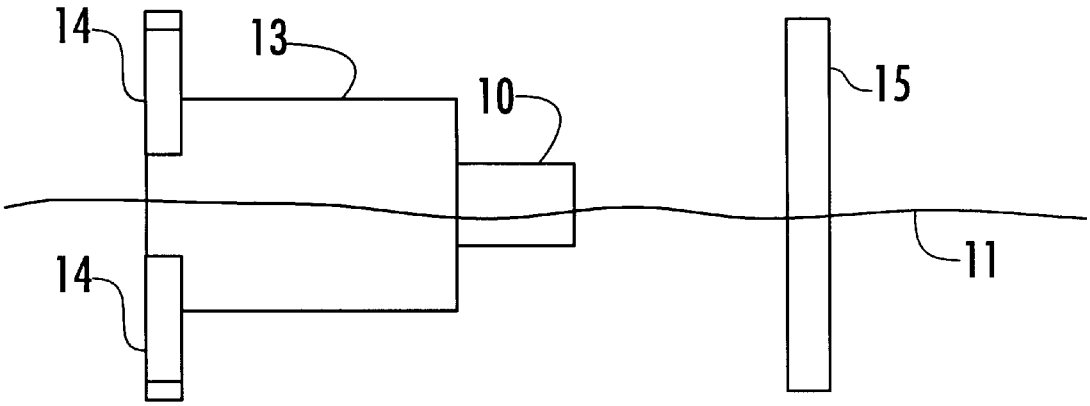
FIG. 3*c* is a plan view of the main buoyancy structure and float ballasted in horizontal orientations.
Figure 3D:
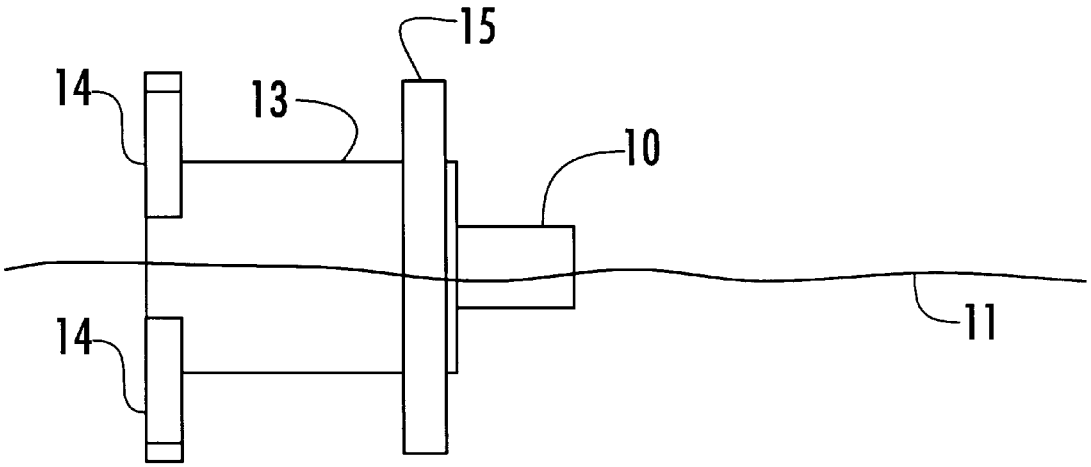
FIG. 3*d* is a plan view of the main buoyancy structure and float locked together.
Figure 3E:
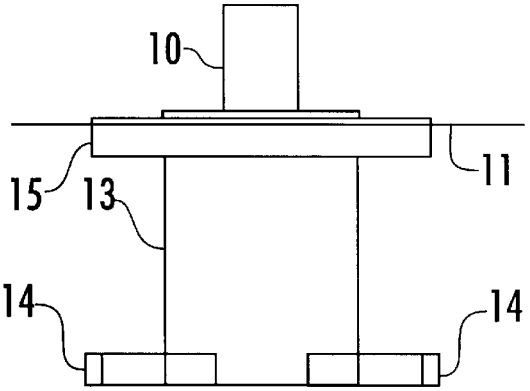
FIG. 3*e* is a plan view of the main buoyancy structure and float ballasted to a vertical orientation.
Figure 3F:
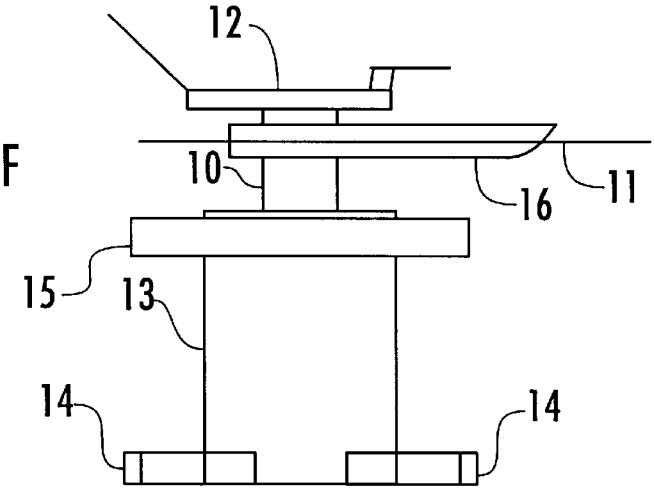
FIG. 3*f* is a plan view of the tension-leg platform and barge for assembling the platform.
Figure 3G:
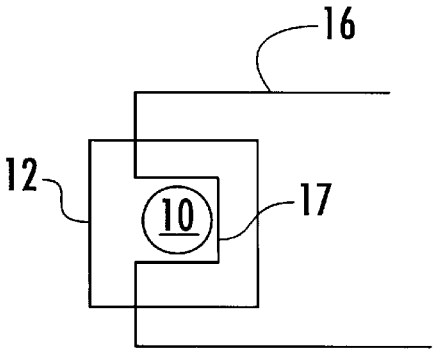
FIG. 3*g* is a top view of the tension-leg platform and barge for assembling the platform.

In Column 2, Lines 13-14, "FIG. 1*a*(1) and 1*a*(2) are plan views of prior art monopod TLP's a plan view of a prior art monopod TLP." should read -- FIG. 1*a*1 and 1*a*2 are plan views of prior art monopod TLP's --.

In Column 2, Line 63, "FIG. 11*a*(1) and 11*a*(2) are views" should read -- FIG. 11*a*1 and 11*a*2 are views --.

In Column 2, Line 65, "FIG. 11*b*(1) and 11*b*(2) are a plan view" should read -- FIG. 11*b*1 and 11*b*2 are a plan view --.

In Column 4, Line 28, the word "and" should read -- an --.

In Column 4, Line 59, "ROV 20 and auxiliary wire 22" should read -- ROV 21 and hook wire 22 --.

In Column 6, Line 21, "handling winch 42" should read -- handling winch (or piston or spring) 42 --.

In Column 6, Line 28, "system, known in the art, may also be used. This stopper 40" should read – systems, known in the art, may also be used. These systems 40 --.

In Column 6, Lines 55-56, "(see FIG. 1*a*(1) and 1*a*(2)), they induce" should read -- (see FIG. 1*a*1 and 1*a*2, they induce --.

In Column 7, Line 17, "Referring to FIG. 11*a*(1) and 11*a*(2)), an attacher" should read -- Referring to FIGs. 11*a*1 and 11*a*2, an attacher --.

In Column 7, Lines 21-22, "FIG. 11*b*(1) and 11*b*(2), the attacher" should read -- FIGs. 11*b*1 and 11*b*2, the attacher --.

UNITED STATES PATENT AND TRADEMARK OFFICE

CERTIFICATE OF CORRECTION

PATENT NO. : 6,007,275
DATED : December 28, 1999
INVENTOR(S) : Knut Borseth

It is certified that error appears in the above-identified patent and that said Letters Patent is hereby corrected as shown below:

In Claim 6, "A mechanism as in claim 4" should read -- The apparatus of claim 4 --.

In Claim 7, "A mechanism as in claim 4" should read -- The apparatus of claim 4 --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*